United States Patent [19]

Weeks et al.

[11] Patent Number: 4,502,799

[45] Date of Patent: Mar. 5, 1985

[54] DOT MATRIX PRINT HEAD

[75] Inventors: David E. Weeks, Newfield; Robert L. Wirth; John W. Reece, both of Ithaca, all of N.Y.

[73] Assignee: NCR Corporation, Dayton, Ohio

[21] Appl. No.: 470,013

[22] Filed: Feb. 25, 1983

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS 3,929,214 12/1975 Hebert ..... 400/124

4,209,260 6/1980 Jung ..... 400/124 X 4,375,338 3/1983 Mitsuishi ..... 400/124

4,423,969 1/1984 Kobryn ..... 101/93.05 X

*Primary Examiner*—Paul T. Sewell

*Attorney, Agent, or Firm*—Wilbert Hawk, Jr.; George J. Muckenthaler

[57] ABSTRACT

A fastener-backstop member secures the coil assemblies to the housing of a print head by means of a flange portion at one end and a plurality of fingers at the other end thereof. The member has a flat surface between the ends thereof to provide a home position for the printing elements.

14 Claims, 4 Drawing Figures

DOT MATRIX PRINT HEAD

CROSS-REFERENCE TO RELATED APPLICATIONS

Dot Matrix Print Head Solenoid Assembly, co-pending application Ser. No. 470,011, filed Feb. 25, 1983, invented by Robert L. Wirth, David E. Weeks and John W. Reece, and assigned to NCR Corporation.

Dot Matrix Print Head, co-pending application Ser. No. 470,012, filed Feb. 25, 1983, invented by David E. Weeks, John W. Reece and Robert L. Wirth, and assigned to NCR Corporation.

BACKGROUND OF THE INVENTION

In the field of printing, the most common type printer has been the printer which impacts against record media that is caused to be moved past a printing line or line of printing. As is well-known, the impact printing operation depends upon the movement of impact members, such as print hammers or wires or the like, which are typically moved by means of an electromechanical system and which system enables precise control of the impact members.

In the field of dot matrix printers, it has been quite common to provide a print head which has included therein a plurality of print wire actuators or solenoids arranged or grouped in a manner to drive the respective print wires a precise distance from a rest or non-printing position to an impact or printing position. The print wires are generally either secured to or engaged by the solenoid plunger or armature which is caused to be moved such precise distance when the solenoid coil is energized and wherein the plunger normally operates against the action of a return spring.

It has also been quite common to provide an arrangement or grouping of such solenoids in a circular configuration to take advantage of reduced space available in the manner of locating the print wires in that area from the solenoid to the front tip of the print head adjacent the record media. In this respect, the actuating ends of the print wires are spaced in accordance with the circular arrangement and the operating or working ends of the print wires are closely spaced in vertically-aligned manner adjacent the record media. The availability of narrow or compact actuators permits a narrower print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer, the print head structure may be a multiple-element type with the wire elements aligned in a vertical line and supported on a print head carriage which is caused to be moved or driven in a horizontal direction for printing in line manner, while the drive elements or transducers may be positioned in a circular configuration with the respective wires leading to the front tip of the print head.

Alternatively, the printer structure may include a plurality of equally-spaced, horizontally-aligned single-element print heads which are caused to be moved in back-and-forth manner to print successive lines of dots in making up the lines of characters. In this latter arrangement, the drive elements or transducers are individually supported along a line of printing. These single wire actuators or solenoids are generally tubular or cylindrically shaped and include a shell which encloses a coil, an armature and a resilient member arranged in manner and form wherein the actuator is operable to cause the print wire to be axially moved a small precise distance in dot matrix printing.

In the concept of dot matrix printing, it is generally desired to place the print element actuators in a position to allow characters to be printed in serial manner and this placement requires that the print wire or like print element actuators be very closely spaced with respect to each other. Since the print actuators are generally much larger in size than the diameter of the printed dot, a relatively long wire or like element must be provided to bring the desired print activity from its source, such as a moving armature or plunger or the like; to a vertical closely-spaced column arranged in a pattern such that the column of closely-spaced, tangentially coincident or overlapping dots will be produced on the record media if all actuators are fired or actuated at one time.

Representative documentation in the field of wire matrix print heads includes U.S. Pat. No. 3,994,381, issued to D. G. Hebert on Nov. 30, 1976, which discloses an electromagnet assembly wherein the magnetic core and the magnetic yoke are secured to the mounting plate by a single nut. An armature retainer is adjustably attached to the yoke and at the hammer end of such retainer is a backstop or bumper which cushions the return shock of the armature back against the retainer, and spring bias means positions the armature in its non-energized position.

U.S. Pat. No. 4,051,941, issued to D. G. Hebert on Oct. 4, 1977, discloses an electromagnetic structure having a coil with inner and outer pole pieces and an armature along with a retainer for maintaining the armature engaged with the outer pole piece. The retainer is secured to a wire guide assembly and also a resilient member dampens the rebound force of each wire upon deenergization of the coil.

U.S. Pat. No. 4,222,674, issued to M. Mori et al. on Sept. 16, 1980, discloses the head portion of a dot printer which has a first yoke along with a fulcrum member and a second yoke for a moving iron core secured to a frame member which is contacted by the printing needle.

U.S. Pat. No. 4,230,038, issued to D. G. Hebert on Oct. 28, 1980, discloses a print head assembly with a plurality of armature members continuously engageable with a first O-ring at an intermediate portion of the members and a second O-ring for continuously engaging a radially outermost portion of the members. The second O-ring serves as a backstop for the armature members in printing operation.

U.S. Pat. No. 4,230,412, issued to D. G. Hebert on Oct. 28, 1980, discloses a print head assembly with a plurality of armature members, each having a drive head portion engaging an impact head portion of the print wire. In one embodiment an O-ring is placed between the drive head portion of the armature member and an adjustment hub member to support the drive head portion, and in another embodiment a flat annular member is used to support the drive head portion.

U.S. Pat. No. 4,244,658, issued to M. Mori on Jan. 13, 1981, discloses a first yoke with a coil frame fitted therein and a second yoke with a flat lever engaging a printing needle and wherein the flat lever is controlled by a suppress member.

And, U.S. Pat. No. 4,279,518, issued to J. E. Blomquist et al. on July 21, 1981, discloses a mounting plate with a yoke portion, a coil assembly and a retaining screw with a resilient backstop. The backstop engages a clapper member, in turn engageable with an actuating end of the printing wire.

SUMMARY OF THE INVENTION

The present invention relates generally to impact printing devices for dot matrix printing wherein at least one print wire or needle is caused to be propelled against a printing medium or like record media by an associated clapper-type, solenoid-actuated, print wire driver for printing dot matrix characters in accordance with external control signals which cause energization of the driver coil and movement of the print wire for enabling printing of the characters. More particularly, the present invention relates to an improved wire matrix print head having a plurality of actuators or drivers positioned for respective print wires and wherein each actuator coil is energized to cause an associated armature or clapper which is engaged with a print wire to propel such print wire or needle a precise distance to mark or print a dot on the record media.

The print wire actuators are arranged in a circular configuration adjacent the print head housing and each of the actuators is associated with the clapper-type armature, in turn engageable with the actuating end of the print wire. The several print wires are arranged to conform with the circular configuration of the print wire actuators at the actuating ends of the print wires and are guided along separate paths to the nose portion of the print head wherein the operating ends of the wires are disposed in a closely-spaced single column so as to effect dot matrix printing.

A fastening member is positioned at one end of the device and is used to secure the actuator coil assembly to the main body or housing of the print head. The fastening member is cylindrically-shaped to fit in apertures or openings through several parts of the print head and includes a lip or flange portion at one end thereof and a plurality of fingers at the other end to secure the parts together.

Additionally, an end surface of the fastening member is positioned to be engageable by one end of each armature and serves as a non-printing or home position seat or backstop therefor. The single member thus serves the combined functions of fastening several parts of the print head and providing a seat for the armatures thereof.

In view of the above discussion, the principal object of the present invention is to provide means for simplifying the assembly of a wire matrix print head.

Another object of the present invention is to provide a single member for securing together several parts of a print head.

An additional object of the present invention is to provide said single member for use as a backstop for the actuating elements of a print head.

A further object of the present invention is to provide a single member, both for securing the print head in assembled condition and for serving as a home position backstop for the print head armatures.

Additional advantages and features of the present invention will become apparent and fully understood from a reading of the following description taken together with the annexed drawing.

DESCRIPTION OF THE PREFERRED EMBODIMENT

Figure 1:
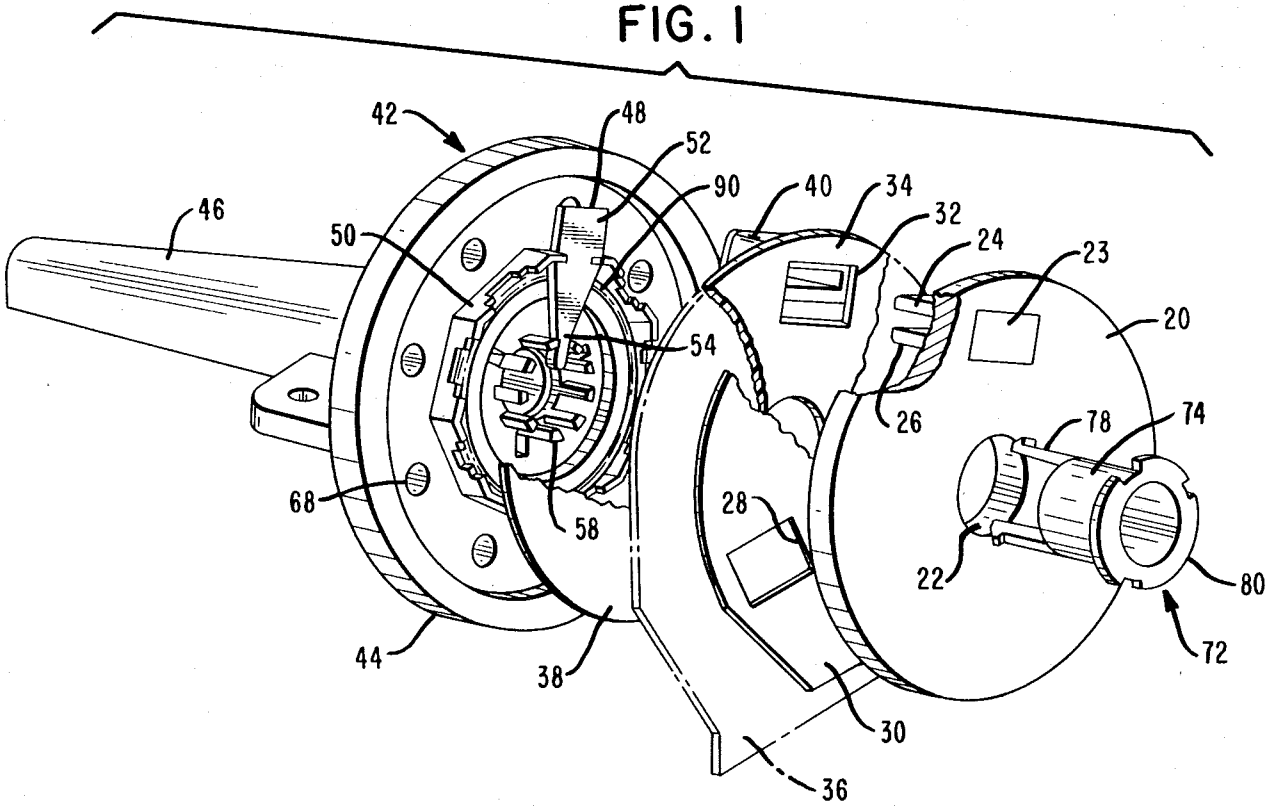
FIG. 1 is a perspective view showing certain parts of a print head in exploded manner.

FIG. 1 is a perspective view which illustrates certain parts of a wire matrix-type print head shown in exploded form and including an aluminum backplate 20 of circular shape with an aperture 22 in the center thereof. A plurality of magnetic core members 23 having pole pieces 24 and 26 are inserted through respective windows in the backplate 20 and are securely attached so as to be flush with one surface of the backplate, with the pole pieces then extending through windows 28 in an insulating spacer 30 of generally circular shape and made of paper or like material. The core member pole pieces 24 and 26 further extend through windows 32 of a printed circuit board 34, also generally circular-shaped, but which includes a lower portion 36 containing socket means for connecting the various components of the circuit board to external wiring. The next element in the arrangement of the print head is a residual spacer 38 of circular shape and sized of smaller diameter than the above-mentioned parts. The function of the spacer 38 is to minimize the effects of residual magnetism between the pole pieces 24 and 26 and an operating member (later described) actuated by the magnet associated with the core member 23. The printed circuit board 34 connects and supports a plurality of actuating coils 40 of electromagnets or solenoids utilized for actuating the print wires in printing operation. The details of construction of the actuating coils 40 of such electromagnets and the printed circuit board 34 are disclosed in the above-referenced co-pending application, Ser. No. 470,011.

Figure 2:
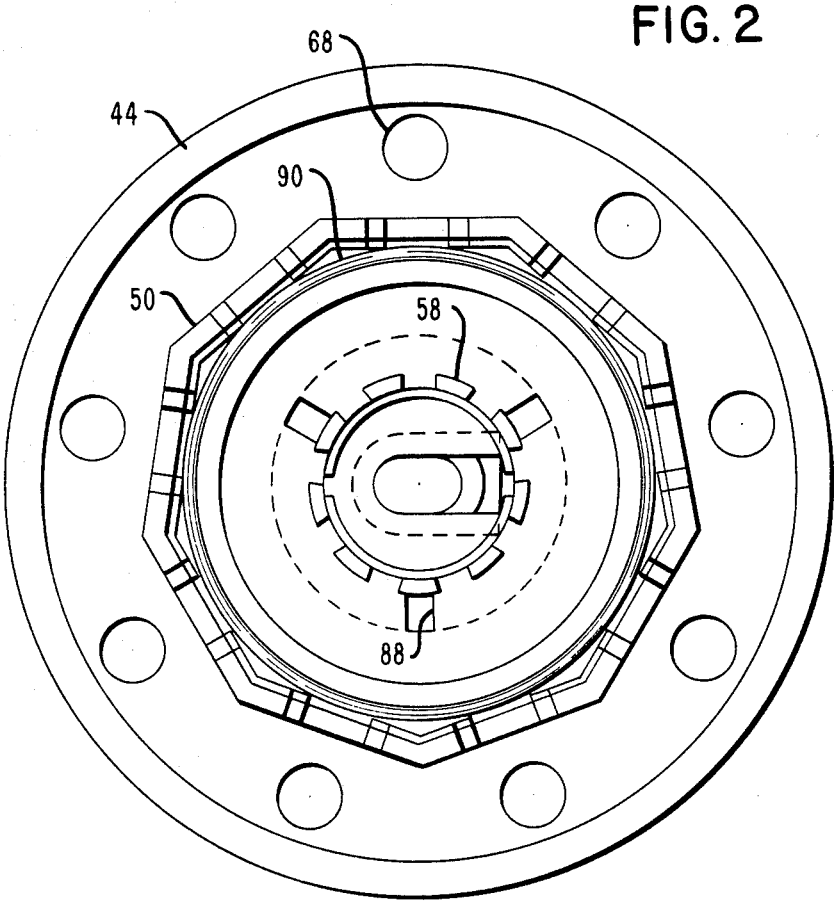
FIG. 2 is an enlarged view of the flange portion of the print head housing.
Figure 4:
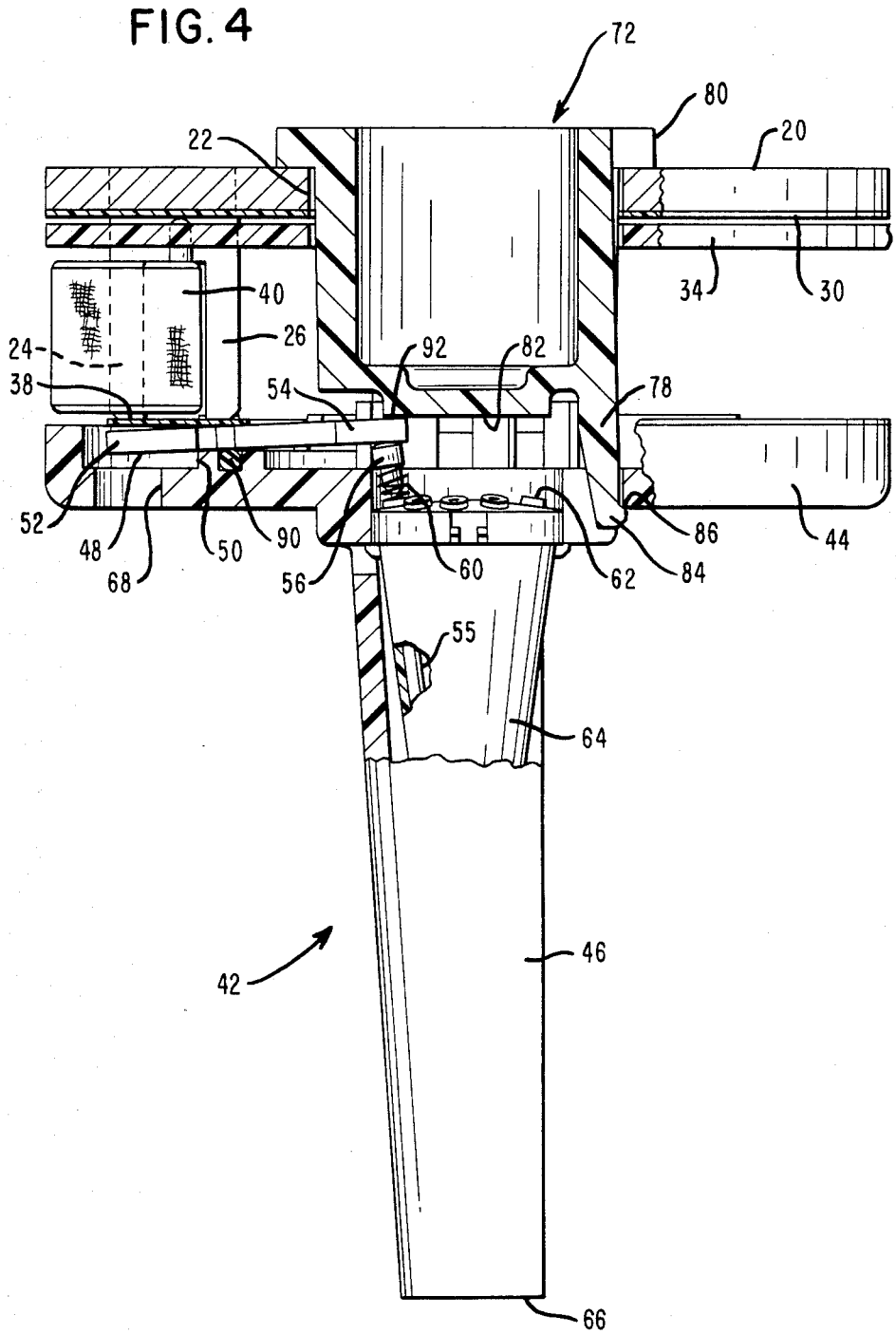
FIG. 4 is a side elevational view, partly in section, and showing the preferred structure of the present invention.

Forward of the residual spacer 38 is the print head housing 42 made of plastic and which generally includes a saucer-shaped flange portion 44 and a nose portion 46 integral therewith (see also FIGS. 2 and 4). The annular flange portion 44 is designed to contain a plurality of print wire engaging members 48 known as clappers which are arranged in a circle and positioned to be operably associated with the respective actuating coils 40. The clapper members 48 are considered to be armatures for the actuating coils 40 and are somewhat paddle-shaped and are supported from a notched framework 50 as a part of the housing flange portion 44. The framework 50 comprises a nine-sided structure with precise notches formed therein for positioning and seating the clapper members 48. Each of the clapper members 48 includes a wide portion 52 at the outer end which is the part operably associated with the coil 40, and a narrow end portion 54 which engages with a print wire 55 (FIG. 4) and which is guided between and maintained in placed by rearwardly extending posts or fingers 58 (FIGS. 1 and 2). Each print wire has a plastic cap 56 (FIG. 4) integrally formed therewith and is biased by a return spring 60 disposed between the cap and a raised surface or seat 62 on an inner circular portion 64 of the nose portion 46 and which spring 60 aids in returning the print wire 55 to the home or non-printing position. The inner portion 64 is designed as one of the structures to carry and to guide the print wires 55 along their respective paths from the raised surface or seat 62 to the front end 66 of the nose portion 46. The details of construction of the means for carrying and guiding the print wires 55 along such respective paths are disclosed in the above-referenced co-pending application, Ser. No. 470,012.

FIG. 2 is an enlarged view of the housing flange portion 44 looking toward the front of the print head and shows the nine-sided framework 50 and the rearwardly extending fingers 58 which therebetween contain the narrow end portions 54 of the clapper or armature members 48. A plurality of apertures 68 (see also FIG. 4) are arranged in a circle around the housing flange portion 44 and correspond with the positions of the respective clapper members 48 for use in manually checking operation of those members and also the print wires 55.

Figure 3:
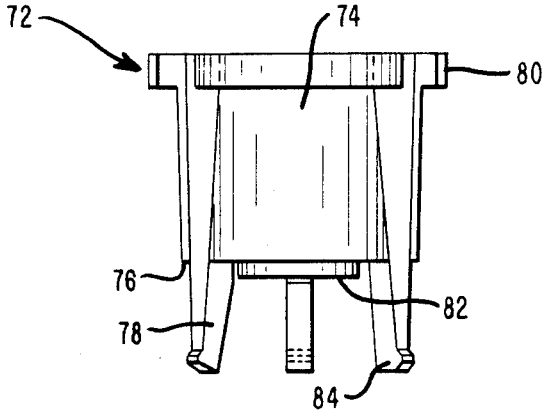
FIG. 3 is an enlarged view of the fastener-backstop member.

FIG. 3 is a side view of the fastener-backstop member, generally designated as 72, and which includes a hollow cylindrical portion 74 with one end portion 76 from which extend three equally-spaced fingers 78. A slotted lip or flange portion 80 (see also FIG. 1) substantially surrounds the opposite end of the cylindrical ortion 74 and a raised central portion 82 closing the one end portion 76 is disposed in a manner spaced from the fingers 78. Each of the fingers 78 has a tip portion 84 which includes an angled surface for engaging with and gripping an edge 86 (FIG. 4) of the housing flange 44. The angled surface is designed to accommodate any variation in distance from the back surface of plate 20 to the edge 86 due to part tolerances.

Further described, FIG. 4 is a side view, partly in section, illustrating the arrangement of the parts in making and in teaching the principles of the present invention. The fastener-backstop member 72 is inserted through the opening 22 in the backplate 20 and the tips 84 of the three fingers 78 thereof are formed to fit through three companion openings 88 (FIG. 2) in the housing flange portion 44 and engage with the outer surface thereof at the edge or point 86. The lip or flange portion 80 engages the backplate 20 around the edge surface of the aperture 22 and thereby fastens and secures the parts together. In this manner, the backplate 20 along with the spacer 30, the printed circuit board 34 and the actuating coils 40 are contained and secured to the housing flange portion 44 by the particular construction of the member 72.

Further, the member 72 serves as a backstop for the clapper members 48 when they are returned from the printing to the home or non-printing position. The raised central portion 82 (FIGS. 3 and 4) of the one end portion 76 of such member 72 provides a seat for the narrow end portions 54 of the clapper members 48 by engagement with one side thereof. The opposite side of each of the narrow end portions 54 of the clapper members 48 engages with the plastic cap 56 of an associated print wire 55 and is biased thereagainst by the action of the spring 60 between the spring seat 62 and the plastic cap.

When the actuating coil 40 is energized, the wide end portion 52 of the associated clapper member 48 is caused to be pulled in a manner whereby the armature or clapper member is pivoted or rocked about a resilient O-ring 90 in a clockwise direction (FIG. 4) and the narrow end portion 54 of such clapper member is moved against the cap 56 to cause the print wire 55 to be moved toward the front end 66 of the print head housing 42 and to a printing position. Upon deenergizing the coil 40, the clapper 48 is rocked in a counterclockwise direction on the O-ring 90 by action of the return spring 60 against the cap 56 and such narrow end portion 54 of the clapper member 48 is returned to rest at point 92 for seating on the central portion 82 of the fastener-backstop member 72.

It shoud be noted that the backplate 20 is made of aluminum, the core members 23 are made of silicon iron and the circuit board 34 is epoxy glass. Further, the clappers or armatures 48 are made of silicon iron and the fastener-backstop 72 is made of glass fiber reinforced plastic material.

It is thus seen that herein shown and described is a fastener-backstop member that serves the combined functions of securing the several parts of the print head together and of providing a rest or home position defining surface for the print wires when they are returned to the non-printing position. The apparatus of the present invention enables the accomplishment of the objects and advantages mentioned above, and while a preferred embodiment has been disclosed herein, variations thereof may occur to those skilled in the art. It is contemplated that all such variations not departing from the spirit and scope of the invention hereof are to be construed in accordance with the following claims.

We claim:

1. A wire matrix print head comprising a
housing portion, a
plurality of print wires extending through said housing portion and movable from a non-printing position to a printing position,
means for actuating the print wires from the non-printing to the printing position,
means for supporting the actuating means in position relative to the housing portion to provide an operating arrangement of the print wires,
armature means operably associated with the actuating means and with the print wires for operating the print wires from the non-printing to the printing position, and a
single, cylindrically-shaped, combined fastener-stop member having a circular flange at one end thereof engageable with said supporting means and having a plurality of extensions at the other end gripping said housing portion for securing thereof and said member providing stop means defining an integral planar surface portion for impact by the armature means upon return of the print wires from the printing to the non-printing position.

2. The print head of claim 1 wherein the housing portion includes an elongated member having guide means for supporting said print wires therealong.

3. The print head of claim 1 wherein the actuating means comprise electromagnetic elements and said armature means comprises rockable members operably connecting said electromagnetic elements with the print wires.

4. The print head of claim 1 wherein the means for supporting the actuating means includes a circuit board operably connected therewith.

5. The print head of claim 1 wherein the armature means includes an elongated clapper element having one end thereof engageable with a respective print wire and with the engageable means and having the other end thereof engageable with the actuating means.

6. The print head of claim 3 wherein the electromagnetic elements are coil wound bobbins supported from a circuit board.

7. The print head of claim 1 including spring means and wherein each print wire includes a head portion continually engageable with the armature means and urged by said spring means toward the non-printing position.

8. In a wire matrix print head having a housing with an elongated portion and an annular portion, a plurality of print wires extending from the annular portion and through the elongated portion to the end thereof, means for actuating the print wires from a non-printing to a printing position, and means adjacent one end of the actuating means for supporting thereof in position for operating the print wires, the improvement comprising a single, cylindrically-shaped, combined fastener-stop member having a circular flange at one end thereof engageable with the supporting means and including a plurality of fingers gripping the annular housing portion for securing thereof and said member having an integral surface portion thereon providing a seating plane for the actuating means upon return of the print wires from the printing to the non-printing position.

9. In the print head of claim 8 wherein the actuating means includes a plurality of electromagnetic elements and corresponding armature members operably associated with respective print wires.

10. In the print head of claim 8 wherein the actuating means includes a plurality of electromagnetic elements and corresponding armatures engageable with the print wires and rockable by said electromagnetic elements for causing the print wires to move from the non-printing to the printing position.

11. In the print head of claim 8 wherein the supporting means for the actuating means includes a circuit board operably connected therewith.

12. In a wire matrix print head having a housing with an elongated portion and an annular portion, a plurality of print wires extending from the annular portion and through the elongated portion to the end thereof, means for actuating the print wires from a non-printing to a printing position, and means adjacent one end of the actuating means for supporting thereof in position for operating the print wires, the improvement comprising a single combined fastener-stop member having a circular flange portion at one end thereof engageable with the supporting means and a, cylindrically-shaped, body portion defining an integral central portion having a plurality of equally-spaced fingers at the other end thereof, said annular portion being formed to receive and grip the ends of the fingers and to secure the actuating means supporting means to the annular portion in assembled manner, said integral central portion providing a surface for impact by the actuating means upon return thereof to the non-printing position.

13. In the print head of claim 12 wherein the ends of the fingers define inclined surfaces engageable with an edge of said annular portion for accommodating tolerances in the supporting means and in the annular portion.

14. In the print head of claim 12 wherein the fastening member is a cylinder open at said one end and includes an end portion for closing the other end and providing a surface engageable by the print wire actuating means in the non-printing position.

* * * * *